United States Patent [19]

Maulandi et al.

[11] Patent Number: 4,757,167

[45] Date of Patent: Jul. 12, 1988

[54] TRIDENT ARC HORN FOR CIRCUIT BREAKER

[75] Inventors: Aymon A. Maulandi; Kevin J. Green, both of Cedar Rapids; Gary A. Volesky, Newhall, all of Iowa

[73] Assignee: Square D Company, Palatine, Ill.

[21] Appl. No.: 922,577

[22] Filed: Oct. 24, 1986

[51] Int. Cl.[4] ..... H01H 9/30; H01H 33/00

[52] U.S. Cl. ..... 200/144 R; 200/146 R

[58] Field of Search ..... 200/144 R, 146 R; 335/202

[56] References Cited

U.S. PATENT DOCUMENTS 2,306,204 12/1942 Boehne ..... 200/144 R 2,626,331 1/1953 Basnett ..... 200/144 R

*Primary Examiner*—E. A. Goldberg

*Assistant Examiner*—Lincoln Donovan

*Attorney, Agent, or Firm*—Mary R. Jankousky; Thomas B. Lindgren

[57] ABSTRACT

A circuit breaker having a contact assembly with a double pivot arrangement. The moving arcing and main contacts provide a smooth surface for meeting the lower arcing contact and the lower main contacts, each mounted on a separate semi-stationary lower blade. The lower arcing contact is positioned higher than the lower main contact, making the arcing contact the last to separate from the moving contact. An arc horn is mounted adjacent the moving contacts to provide a path for movement of the arc from the upper contact into the arc stack assembly. The arc horn has three fingers, each of which passes through the cutaway portion of each arc plate of the arc stack assembly upon the contacts separating.

16 Claims, 3 Drawing Sheets

TRIDENT ARC HORN FOR CIRCUIT BREAKER

This invention relates to a circuit breaker having main contacts and arcing contacts and in particular to a circuit breaker having an arcing horn.

CROSS REFERENCE TO RELATED APPLICATION

The present invention is related to material disclosed in the following copending U.S. applications, all of which are assigned to the same assignee of the present application and are herein incorporated by reference:

Ser. No. 922,966, entitled "Circuit Breaker Arc Stack Assembly" filed Oct. 24 1986 by J. M. Winter;

Ser. No. 922,968, entitled "Circuit Breaker with Positive Contact Indication" filed Oct. 24. 1986 by J. M. Winter D. R. Schiefen;

Ser. No. 922,576, entitled "Circuit Breaker Contact Assembly" filed Oct. 24, 1986 J. M. Winter;

Ser. No. 922,967, entitled "Circuit Breaker Trip Solenoid Assembly" filed Oct. 24, 1986 by J. M. Winter, R. F. Dvorak;

Ser. No. 922,575, entitled "Electronic Circuit Breaker with Withstand Capability" filed Oct. 24, 1986 by J. M. Winter.

BACKGROUND OF THE INVENTION

As the interrupting and overload switching requirements of circuit breakers increase, contact erosion usually increases. Arcing erodes the circuit breaker contact material shortening the contact life. Contact erosion may be reduced by supplying each phase of the circuit breaker with arcing contacts in addition to the main current carrying contacts. Arcing contacts are made of an arc resistant material such as silver tungsten. The arcing contacts are the first contacts to mate upon the breaker closing and the last contacts to separate upon the breaker opening. Thus the arc is drawn between the arcing contacts.

The arc resistant material of the arcing contacts usually has a relatively high resistance. The arcing erosion of the contacts increases that resistance. Separate main contacts are relied upon to carry the current when the circuit breaker is in the closed position. The main contact material, such as silver cadmium oxide generally has a lower resistance than that of the arcing contacts but is also less resistant to arcing erosion than the arcing contact material. The conventional configuration for a contact assembly in a single pivot circuit breaker is shown in FIG. 1. This type of circuit breaker often has fixed lower contacts and pivoted moving contacts. The moving arcing contact blade is lonqer than the moving main contact blades to keep the arc away from the main contacts and facilitate its transfer to the stack.

As customers began reguiring higher withstand capabilities of circuit breakers, the constriction forces between the contacts could cause the contacts to blow open below the desired withstand level. The single pivot circuit breaker designs were replaced with double pivot circuit breakers that have a blow on loop as shown in FIG. 2. The opposing path of the current in the line terminal 102 and semi-stationary contact 103 causes the semi-stationary contact to move upwards. Pressing against the moving contacts. As the current increases, the blow on loop force increases. giving the breaker the capability to withstand higher fault currents.

The longer arcing contact blade of the single pivot is not easily used with a double pivot configuration since it requires many additional components and is not cost effective.

The double pivot design often utilizes main contact blades 106 and arcing contact blades 108 of the same length, as shown in FIG. 3. An arcing horn 110 extends beyond the center arcing contact to provide an arc path away from the contacts. This design suffers excessive arcing on the outer main contacts especially during multi-phase faults at the overload switching levels.

There is a need for a contact assembly adaptable for use with a double pivot circuit breaker to quickly transfer the arc off the arcing or main contacts.

There is a further need for a contact assembly adaptable for use for a double pivot circuit breaker to more; effectively elongate and cool the arc in the arc stack.

These and other features of this invention will become more readily apparent from the following description, claims and drawings.

DESCRIPTION OF THE INVENTION

Figure 1:
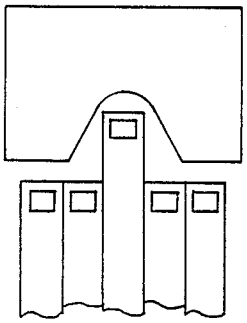
FIG. 1 PRIOR ART
FIG. 1 shows a bottom view of a prior art moving contact assembly and arc plate for a single pivot circuit breaker design.
Figure 2:
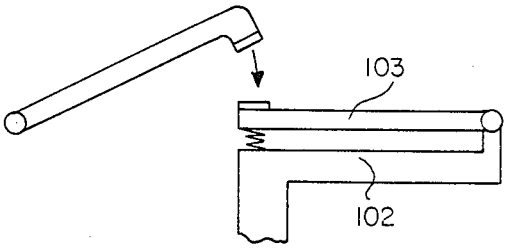
FIG. 2 shows a schematic side view of a contact assembly of a double pivot circuit breaker.
Figure 2A:
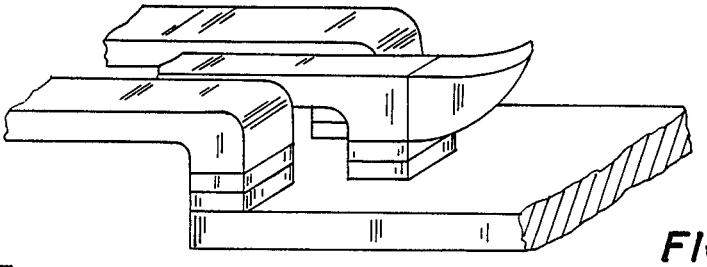
FIG. 2A shows a perspective view of a portion of the contact assembly of a single pivot circuit breaker design.
Figure 3:
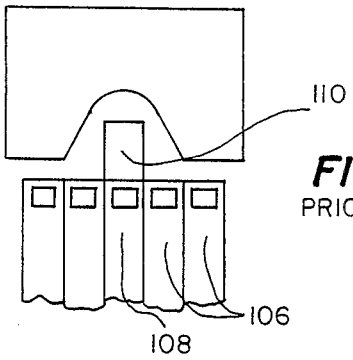
FIG.3 PRIOR ART
FIG. 3 shows a bottom view of a prior art moving contact assembly and arc plate of a double pivot circuit breaker.
Figure 5:
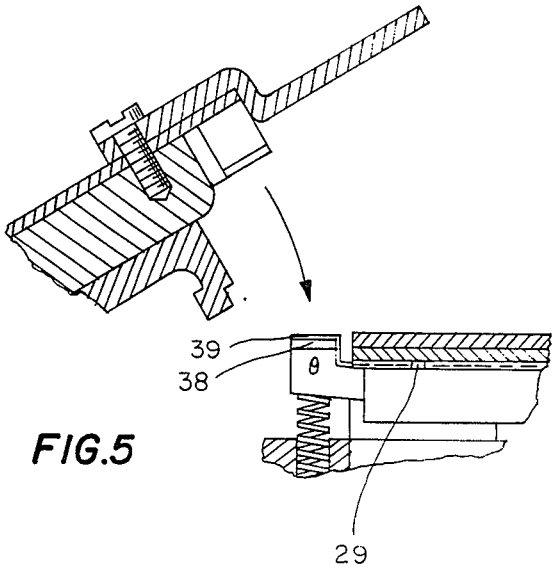
FIG. 5 shows a side view of the contact and arc stack assembly of FIG. 4.
Figure 4:
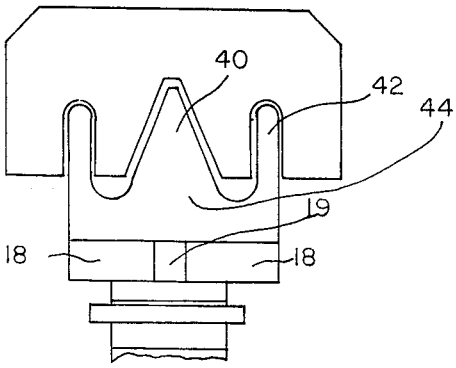
FIG. 4 shows a bottom view of an arc stack plate and moving contact assembly having a trident horn.
Figures 6, 7, 8:
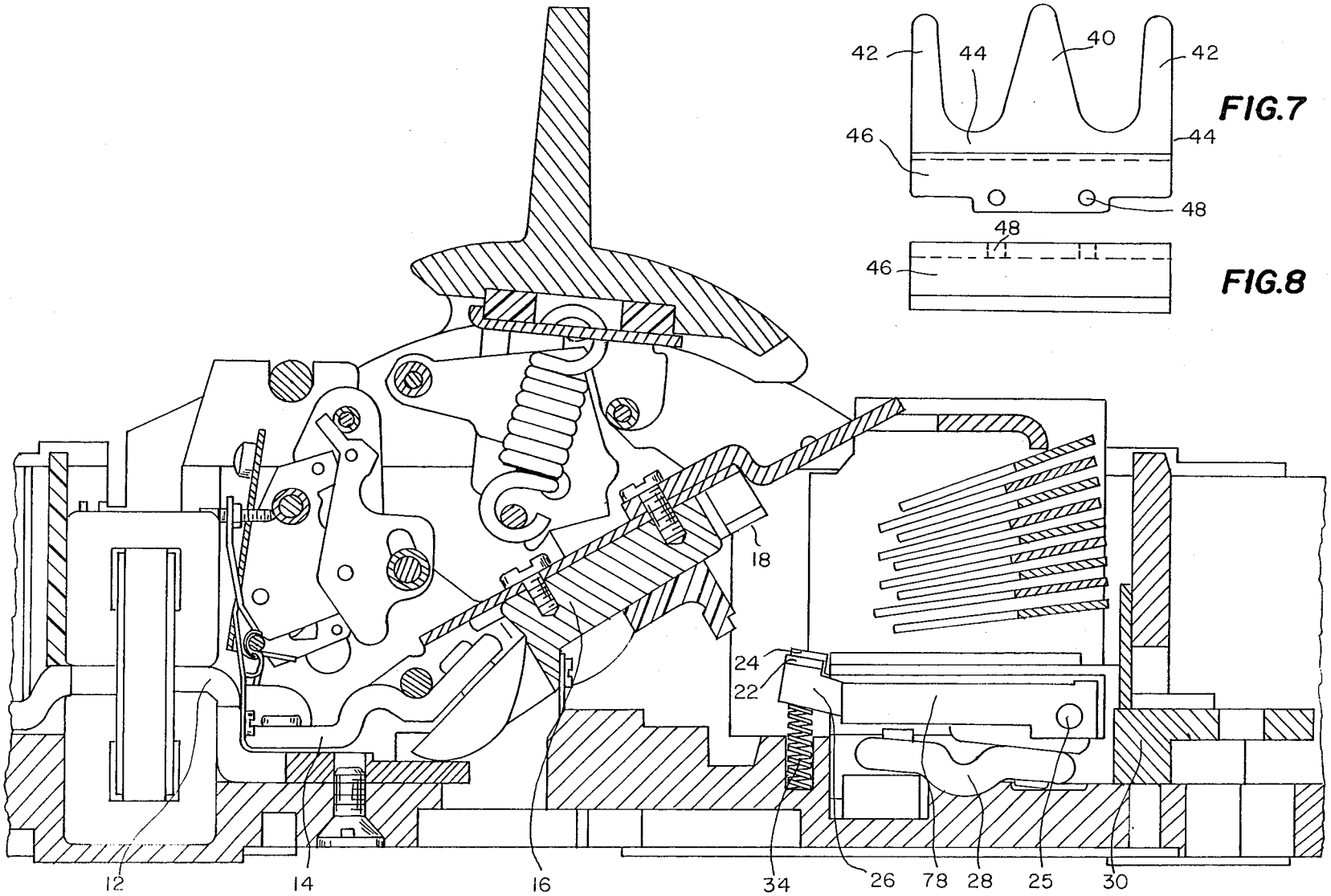
FIG. 6 shows a sectional view of a circuit breaker using the contact and arc stack assembly of FIG. 4.
FIG. 7 shows a top view of the trident arc horn.
FIG. 8 shows a front view of the trident arc horn.
Figure 9:
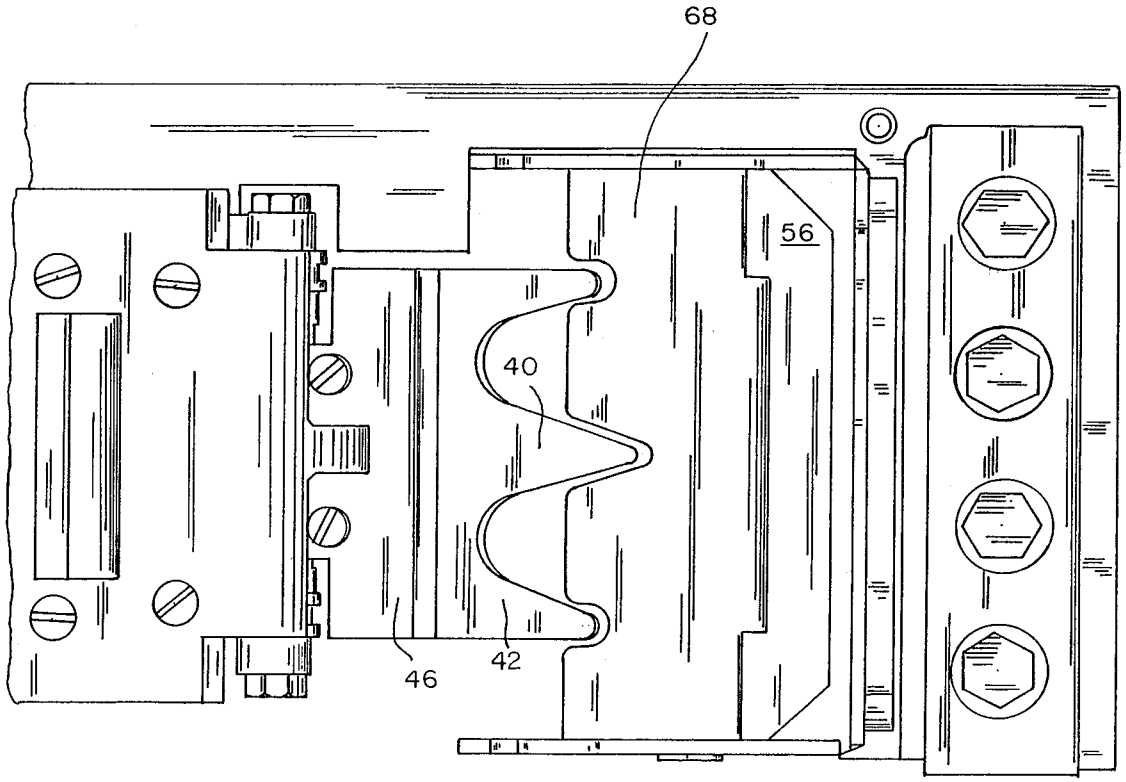
FIG. 9 shows a top view of a portion of the circuit breaker.

Referring now to the drawings and in particular to FIG. 6, a circuit breaker, indicated generally as 10, is shown with a double pivot contact assembly. The current path through the circuit breaker 10 is via the load terminal 12. load side flexible connector 14, moving blade 16. moving main and arcing contacts 18 and 19, respectively. lower main and arcing contacts 22 and 24, respectively, lower blades 26 and 27, line side flexible connector 28 and line terminal 30.

As discussed above, the withstand capabilities of the circuit breaker are increased by mounting both the moving blade 16 and lower blades 26 on pivots. The blow on loop created by the opposite current flow in the line side flexible connector 28 and the lower blades 26 and 27 forces the lower main and arcing contacts, 22 and 24 respectively, against the moving main and arcing contacts 18 and 19, respectively, or moving contact assembly to increase the contact pressure.

Two moving main contacts 18 each comprised of a solid rectangle of cadmium silver oxide, are positioned opposite the lower main contacts 22. A moving arcing contact 19 is located between the two moving main contacts 18 and is made of silver tungsten. Both the moving main contacts 18 and the moving arcing contact 19 are mounted on the upper blade 16. The moving contacts provide a level contact surface to meet the lower main contacts and lower arcing contacts in the circuit breaker closed position.

The lower main blades 26 and lower arcing blade 27 are mounted on a lower pivot 25 and are contained within a lower blade carrier 78 that limits the lower blade movement. Individual springs 34 mounted below each lower blade 26 and 27 apply contact force to each of the respective pairs of contacts. The lower main blades 26 and lower arcing blades 27 are semi-stationary, moving only to maintain the necessary contact force. Each lower main blade 26 has a stop 29 between the respective blade and the lower blade carrier 78. The lower main blade stops 29 position the lower main contacts 22 farther from the moving contacts than the lower arcing contact. Because relatively equal force is applied to the lower main blades 26 and lower arcing blade 27, the moving and lower arcing contacts 19 and 24, respectively, are the first to mate and the last to separate. Thus the arc will be drawn between the moving and lower arcing contacts 19 and 24. respectively.

The arc horn 36 is mounted on the movable blade carrier 38. The arc horn 36 includes a middle finger 40 and two outer fingers 42 joined at a base 44. A flange 46 is formed at a right angle to the fingers 40 and 42 and base 44. The flange 46 has two holes 48 for mounting the arc horn 36 directly to the movable blade carrier 38 with screws.

The arc stack assembly 52, mounted above the lower blades 26 and 27, is positioned along the movement path of the moving contacts 18. After the arc is drawn between the moving contact 18 and arcing contact 24, electrodynamical forces generated by the arc tend to force it outwards onto the arc horn 36 and into the arc stack assembly 52. The backshield 84 prevents the gases from expanding in the direction of the mechanism. The arc stack assembly 52 helps to elongate and to cool the arc, speeding the extinction of the arc.

The arc stack assembly 52 is comprised of a series of radially spaced and approximately parallel metal arc plates of varying lengths, indicated generally as 54. As shown in FIG. 6, the arc plates are alternately positioned short plates 56 and long plates 58, each having four projections 62. The projections 62 form three cutaway portions 66 in each arc plate.

As the circuit breaker mechanism, indicated generally as numeral 70. is released either as a result of manual operation or upon the occurrence of an overcurrent, the toggle spring 72 causes the blade 16 and moving contacts to open. The operation of the circuit breaker mechanism is described in more detail in Ser. No. 922,966, for a "Circuit Breaker with Positive Contact Indication", as described above. As the contacts separate, an arc is drawn between the moving arcing contact 20 and the lower arcing contact 24. Forces acting upon the arc move it both laterally to the main contacts 22 and outwardly to the arc horn 36. The lateral forces are predominant in the three phase interruptions and may be due to magnetic interference between phases. The outward forces result from expanding gases in the vicinity of the arc and electrodynamical forces generated by the curren path layout.

As the contacts separate, the arc horn fingers 40 and 42 pass through cutaway portions 66 of each arc plate. If the arc initially moves laterally to the outside main contacts. the magnetic forces will eventually push it outward to one of the outer fingers 42 of the arc horn 36.

The prior art arc horn had only one finger and would have been utilized only upon an arc moving directly outward from the center moving arcing contact 20. In the prior art, any arc moving to the lower main contacts 22 located on the outside of the contact assembly would remain there for a period of time before transferring to the arc runner and to the arc stack. The arc on the main contacts will generate undesirable erosion of contact material.

The trident arc horn 36 helps the transter of the arc from the main and arcing contacts to the upper runner 68 and arc stack assembly 52 even in presence of electrodynamical lateral forces. This reduces considerably the erosion of the main contacts during overload switching. Because it is efficient in keeping the arc in the arc stack until extinction, the trident arc horn reduces the chance of restrike at the contacts during single phase full voltage interruptions.

In the instant invention as the contacts separate. the lower end of the arc moves from the arcing contact 24 to the lower runner 76. The lower runner 76 is mounted on the main blade carrier directly beneath the arc stack assembly.

While the invention has particularly been shown and described with reference to a preferred embodiment, it will be understood by those skilled in the art that variations in form, construction and arrangement may be made without departing from the spirit and scope of the invention. All such variations are intended to be covered in the appended claims.

We claim:

1. A circuit breaker comprising:

a movable contact;

a second contact;

a movable blade having a longitudinal axis, said movable contact being mounted on said movable blade and being movable between a closed position and an open position to open and close an electric circuit, said movable contact and said second contact being in contact with one another in the closed position, said movable contact and said second contact are a distance from one another in the open position;

an arc horn mounted juxtaposed said movable contact, said arc horn having a plurality of fingers approximately parallel to the longitudinal axis of said movable blade;

an arc stack positioned adjacent said second contact and said movable contact, said arc stack including a plurality of arc plates, each arc plate having a cutaway portion, whereinupon said movable blade moving between the open position and the closed position, said arc horn fingers pass through the cutaway portion of each arc plate; and wherein each of said arc plates comprises a plurality of respective cutaway portions, whereupon said movable blade moving between open position and the closed position, each arc horn finger passes through a respective cutaway portion of each arc plate.

2. A circuit breaker as claimed in claim 1 whereupon said movable contact includes a arcing contact and a main contact, whereupon said arc horn is mounted juxtaposed said arcing contact and said main contact.

3. A circuit breaker as claimed in claim 2 wherein said arcing contact and said main contact form a line substantially perpendicular to the longitudinal axis of said movable blade.

4. A circuit breaker as claimed in claim 3 wherein said movable blade rotates to actuate said movable contact, wherein said second contact is mounted on a pivoted second blade.

5. A circuit breaker comprising:

an arcing contact mounted on a pivotable arcing blade;

a plurality of main contacts, each of said main contacts being mounted on a pivotable main blade positioned on either side of said arcing blade, each of said main contacts being positioned adjacent either side of said arcing contact;

a movable contact assembly mounted on a pivotable movable blade, said movable blade being movable between a closed position and an open position, wherein in the closed position said movable contact assembly is in contact with both said arcing contact and said main contacts, wherein in the open position said movable contact assembly is a distance from both said arcing contacts and said main contacts;

an arc horn having a plurality of fingers, said arc horn connected adjacent said movable contact assembly; and an arc stack assembly positioned adjacent said movable contact assembly, said arcing contacts and said main contacts, whereupon said movable blade pivoting between the open position and the closed position said arc horn passes through said arc stack assembly; wherein said arc stack assembly comprises a plurality of arc plates, each of said arc plates having a plurality of cutaway portions, whereupon said movable blade pivoting between the open position and the closed position each of said arc horn fingers pass through a respective cutaway portion of each of said arc plates.

6. A circuit breaker as claimed in claim 5 whereupon said movable contact includes a arcing contact and a main contact, whereupon said arc horn is mounted juxtaposed said arcing contact and said main contact.

7. A circuit breaker as claimed in claim 6 wherein said arcing contact and said main contact form a line substantially perpendicular to the longitudinal axis of said movable blade.

8. A circuit breaker as claimed in claim 7 wherein said movable blade rotates to actuate said movable contact, wherein said second contact is mounted on a pivoted second blade.

9. A circuit breaker comprising:

a movable contact;

a second contact;

a movable blade having a longitudinal axis, said movable contact being mounted on said movable blade and being movable between a closed position and an open position to open and close an electrical circuit, said movable contact and said second contact being in contact with one another in the closed position, said movable contact and said second contact are a distance from one another in the open position;

an arc horn mounted juxtaposed said movable contact, said arc horn having three fingers approximately parallel to the longitudinal axis of said movable blade; and an arc stack positioned adjacent said second contact and said movable contact, said arc stack including a plurality of arc plates, each of said arc plates having a cutaway portion, whereupon said movable blade moving between the open position and the closed position, said arc horn fingers pass through the cutaway portion of each arc plate wherein each of said arc plates comprises three cutaway portions, whereupon said movable blade moving between the open position and the closed position, each arc horn finger passes through a respective cutaway portion of each arc plate wherein each of said arc plates comprises three cutaway portions, whereupon said movable blade moving between the open position and the closed position, each arc horn finger passes through a respective cutaway portion of each arc plate.

10. A circuit breaker as claimed in claim 9 whereupon said movable contact includes a movable arcing contact and a movable main contact, whereupon said arc horn is mounted adjacent both said movable arcing contact and said movable main contact.

11. A circuit breaker as claimed in claim 10 wherein said movable arcing contact and said movable main contact form a line substantially perpendicular to the longitudinal axis of said movable blade.

12. A circuit breaker as claimed in claim 11 wherein said movable blade rotates to move said movable contact, wherein said second contact is mounted on a pivoted second blade.

13. A circuit breaker comprising:

an arcing contact mounted on a pivotable arcing blade;

a plurality of main contacts, each of said main contacts being mounted on a pivotable main blade positioned on either side of said arcing blade, each of said main contacts being positioned adjacent either side of said arcing contact;

a movable contact assembly mounted on a pivotable movable blade, said movable blade being movable between a closed position and an open position, wherein in the closed position said movable contact assembly is in contact with both said arcing contact and said main contacts, wherein in the open position said movable contact assembly is a distance from both said arcing contacts and said main contacts;

an arc horn having three fingers, said arc horn connected adjacent said movable contact assembly; and an arc stack assembly positioned adjacent said movable contact assembly, said arcing contacts and said main contacts, whereupon said movable blade pivoting between the open position and the closed position said arc horn passes through said arc stack assembly wherein said arc stack assembly comprises a plurality of arc plates each of said arc plates having three cutaway portions, whereupon said movable blade pivoting between the open position and the closed position each of said arc horn fingers passes through a respective portion of each of said arc plates.

14. A circuit breaker as claimed in claim 13 whereupon said movable contact includes a movable arcing contact and a movable main contact, whereupon said arc horn is mounted adjacent both said movable arcing contact and said movable main contact.

15. A circuit breaker as claimed in claim 14 wherein said movable arcing contact and said movable main contact form a line substantially prependicular to the longitudinal axis of said movable blade.

16. A circuit breaker as in claim 15 wherein said movable blade rotates to move said movable contact, wherein said second contact is mounted on a pivoted second blade.

* * * * *